US008009103B2

(12) United States Patent
Chang

(10) Patent No.: US 8,009,103 B2
(45) Date of Patent: Aug. 30, 2011

(54) TRIPLE-BAND ANTENNA

(75) Inventor: Yu-Min Chang, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 398 days.

(21) Appl. No.: 12/401,727

(22) Filed: Mar. 11, 2009

(65) Prior Publication Data

US 2010/0039344 A1 Feb. 18, 2010

(30) Foreign Application Priority Data

Aug. 13, 2008 (CN) ..... 2008 1 030751

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS

See application file for complete search history.

(56) References Cited

U.S. PATENT DOCUMENTS

| | | | | |
|---|---|---|---|---|
| 7,940,219 | B2 * | 5/2011 | Soekawa et al. | 343/702 |
| 2003/0052824 | A1 * | 3/2003 | Ollikainen et al. | 343/700 MS |
| 2005/0122267 | A1 * | 6/2005 | Sim et al. | 343/702 |
| 2008/0180333 | A1 * | 7/2008 | Martiskainen et al. | 343/722 |

* cited by examiner

*Primary Examiner* — Hoanganh Le

(74) *Attorney, Agent, or Firm* — Altis Law Group, Inc.

(57) ABSTRACT

The disclosure discloses a triple-band antenna including a feed line, a first radiating body, a second radiating body and a grounding sheet. The first radiating body is a rectangular sheet. One end of the first radiating body is electrically connected with the end of the feed line. The second radiating body includes three parallel bar shape sheets extending from the first radiating body and surrounded by the first radiating body, and both share the feed line. The grounding sheet is disposed beside the feed line. The first radiating body and the second radiating body of the triple-band antenna generate three resonance frequencies according to the radio frequency received by the feed line to allow the triple-band antenna work under three different operating frequencies.

19 Claims, 14 Drawing Sheets

Y-Z plane

Vertical

Horizontal

Z-X plane

Vertical

Horizontal

X-Y plane

Vertical

Horizontal

Y-Z plane

Vertical

Horizontal

Z-X plane

Vertical

Horizontal

X-Y plane

Vertical

Horizontal

Y-Z plane

Vertical

Horizontal

Z-X plane

Vertical

Horizontal

TRIPLE-BAND ANTENNA

BACKGROUND

1. Technical Field

The present disclosure generally relates to antennas for portable wireless communication devices, particularly to a triple-band antenna.

2. Discussion of the Related Art

With the developments of wireless communication and information processing technologies, portable wireless communication devices such as mobile phones and personal digital assistants (PDAs) are now in widespread use, and consumers may now enjoy the full convenience of high-end electronics products almost anytime and anywhere.

Typical portable wireless communication devices generally include a single band antenna to transmit and receive electromagnetic waves. The single band antenna provides only one frequency band for communication and cannot satisfy the consumer's desire that their electronic device be operated at multiple frequency bands. A dual-band antenna can solve the aforesaid problems. However, the volume of the conventional dual-band antenna is relatively large, and occupies a relatively large space within the portable wireless communication device. In addition, the conventional dual-band antenna is not suitable for developing a communicating system providing more than two frequency bands.

Therefore, there is room for improvement within the art.

BRIEF DESCRIPTION OF THE DRAWING

Many aspects of the present triple-band antenna can be better understood with reference to the following drawings. The components in the drawings are not necessarily drawn to scale, the emphasis instead being placed upon clearly illustrating the principles of the present triple-band antenna. Moreover, in the drawings, like reference numerals designate corresponding parts throughout the several views.

DETAILED DESCRIPTION OF THE EMBODIMENT

Figure 1:
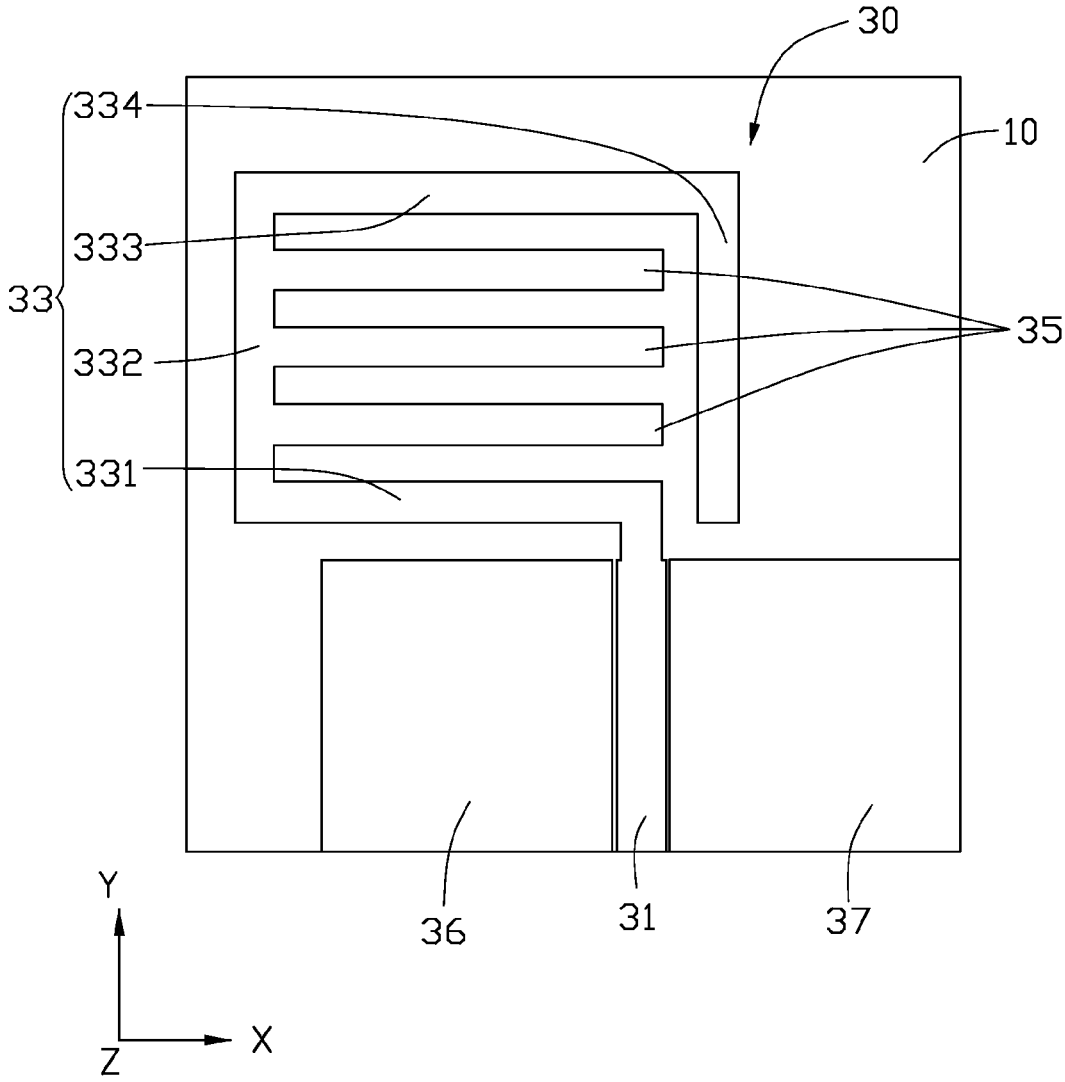
FIG. 1 shows a top view of a triple-band antenna mounted on a circuit board, according to an exemplary embodiment.

Referring to FIG. 1, a triple-band antenna 30 is a flat plane antenna according to an exemplary embodiment feeding signals using coplanar waveguides. The triple-band antenna 30 is disposed on an insulated board 10 of a portable wireless communication device (not shown) such as a mobile phone or personal digital assistant for transmitting and receiving signals, such as radio waves and datum signals. The insulated board 10 is a substantially rectangular board and may be made of fiberglass and may have a permittivity of about 4.4, a loss tangent of about 0.02, and a thickness of about 1.6 mm. In the exemplary embodiment, the triple-band antenna 30 is made of copper material and disposed on the insulated board 10 by engraving technology.

The triple-band antenna 30 includes a feed line 31, a first radiating body 33, a second radiating body 35, a first grounding sheet 36 and a second grounding sheet 37. The first radiating body 33 is a substantially rectangular sheet, having a length of about a quarter of a wavelength of a first resonant frequency, which is about 900 MHz. One end of the first radiating body 33 is electrically connected to an end of the feed line 31, and the other end of the first radiating body 33 is a free end parallel with the feed line 31.

The first radiating body 33 includes a first radiating arm 331, a second radiating arm 332, a third radiating arm 333 and a fourth radiating arm 334 electrically connected in series to each other. The first radiating arm 331 is perpendicular and electrically connected to the feed line 31. The fourth radiating arm 334 is parallel with the feed line 31, and parallel with the second radiating arm 332. An end of the fourth radiating arm 334 is spaced from the junction of the first radiating arm 331 and the feed line 31.

The second radiating body 35 includes three bar-shaped sheets extending from the second radiating arm 332 toward the fourth radiating arm 334. The three sheets of the second radiating body 35 are parallel with each other, and are equally spaced. The second radiating body 35 is surrounded by the first radiating body 33.

The first grounding sheet 36 and the second grounding sheet 37 are disposed at opposite sides of the feed line 31. The first and second grounding sheets 36, 37 are equally spaced from the feed line 31, and a distance between the first grounding sheet 36 and the feed line 31 is adjustable to adjust a third resonant frequency of the triple-band antenna 30.

When the triple-band antenna 30 is in use, the feed line 31 receives outer signals and transmits the signals from the first radiating body 33 and the second radiating body 35 to form three different transmission routes of different lengths. The first radiating body 33 and the second radiating body 35 form three different signal currents and generate three different operating frequencies respectively to make the triple-band antenna 30 able to work with three communication systems, e.g. GSM900, DCS1800 and WLAN2450. When the signals are transmitted along the first radiating body 33, a first resonant operating frequency of 900 MHz can be generated to allow the triple-band antenna to work on GSM900 communication system. When the signals are transmitted along the second radiating body 35, a second resonance operating frequency of 1800 MHz can be generated to allow the triple-band antenna to work on DCS1800 communication system. When the signals are transmitted along the first radiating body 33 and the second radiating body 35, a third resonance operating frequency of 2450 MHz can be generated to allow the triple-band antenna 30 to work on WLAN2450 communication system.

Figure 2:
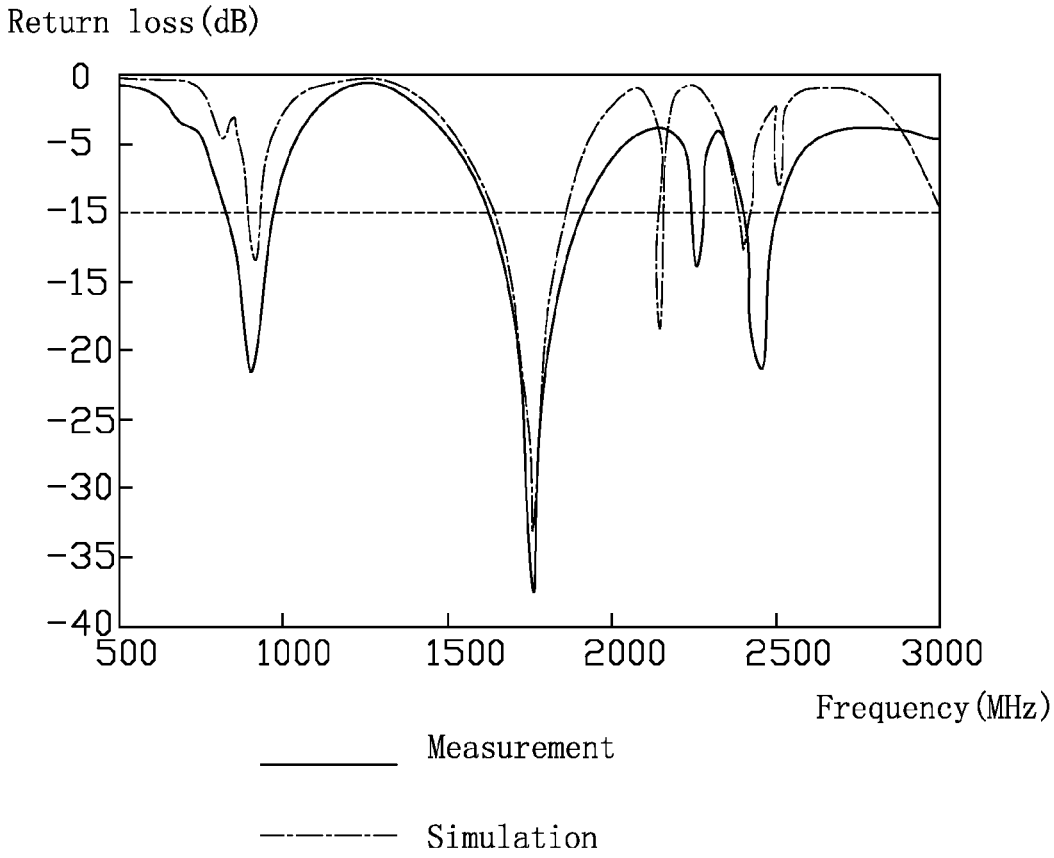
FIG. 2 shows a comparison graph of a test result and a simulated result obtained from the triple-band antenna of FIG. 1, disclosing returning loss varying with frequency.

Referring now to FIG. 2, a comparison graph of a test result and a simulated result obtained of the triple-band antenna, shows return loss varying with frequency. The triple-band antenna 30 generates three resonant frequencies near the frequency of 900 MHz, 1800 MHz and 2450 MHz during the test respectively. According to the graph of FIG. 3, the test return loss and the simulated return loss are very similar; and achieve the design requirements. The bandwidth of the triple-band antenna 30 is suitable for working under GSM900, DCS1800 and WLAN2450 three communication systems.

Figure 3:
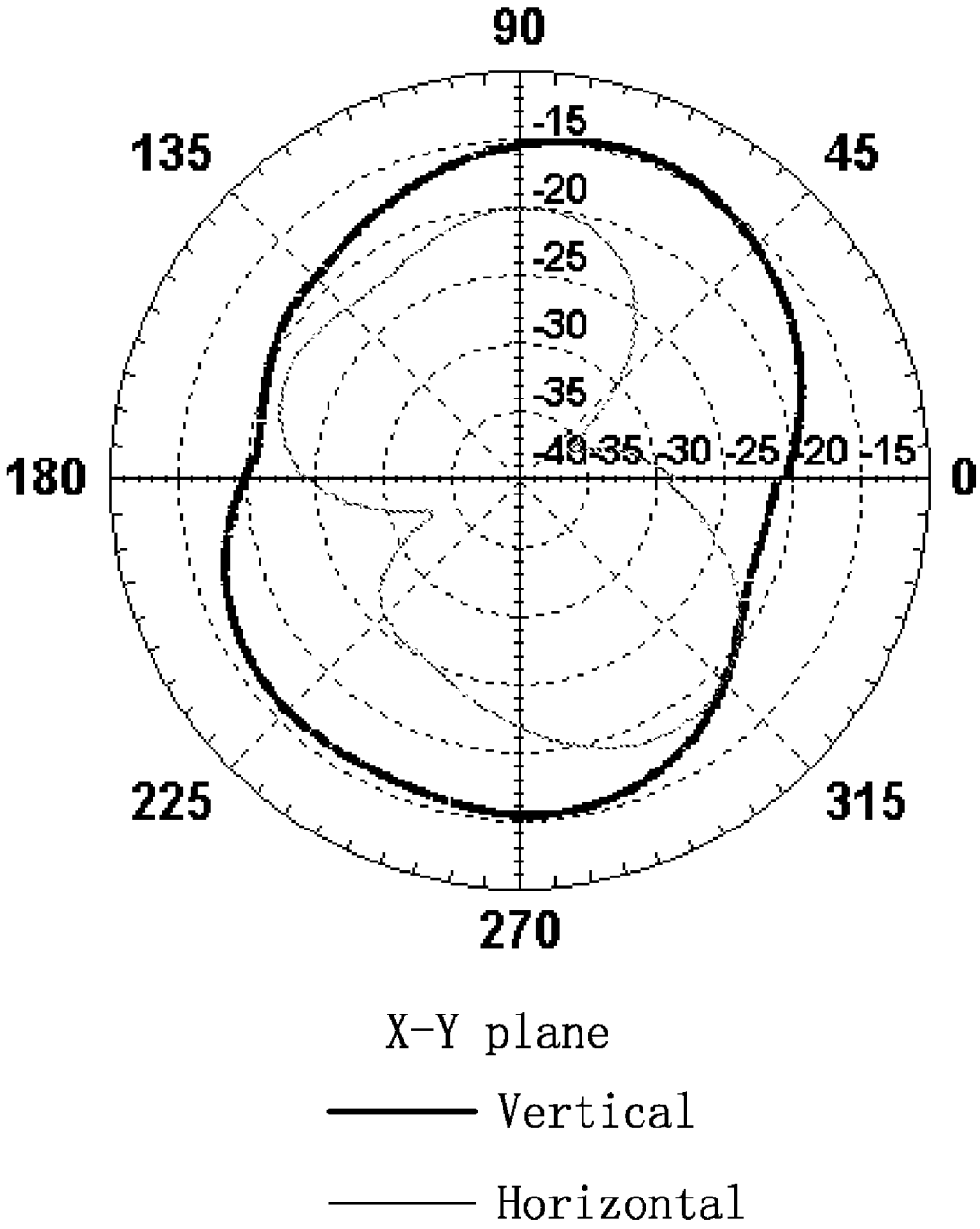
FIGS. 3 to 5 show measured horizontal and vertical polarized radiation directional patterns of X-Y, Y-Z and Z-X planes of the triple-band antenna operating at 900 MHz respectively.
Figure 4:
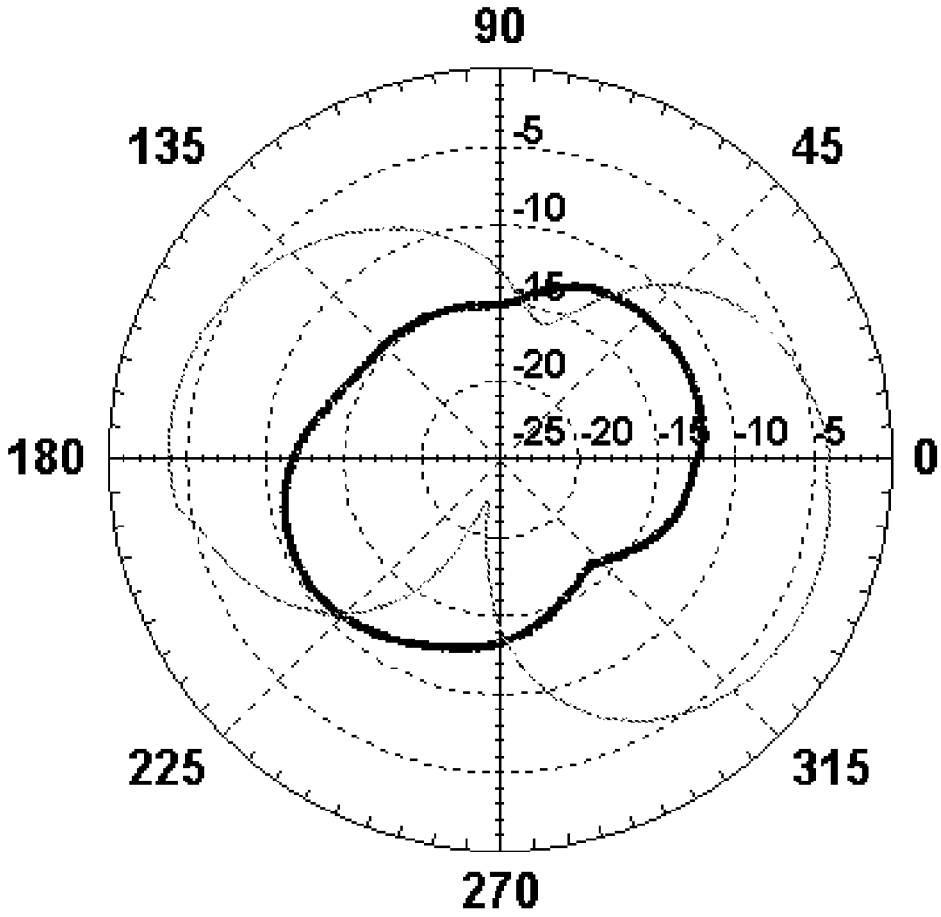
Figure 5:
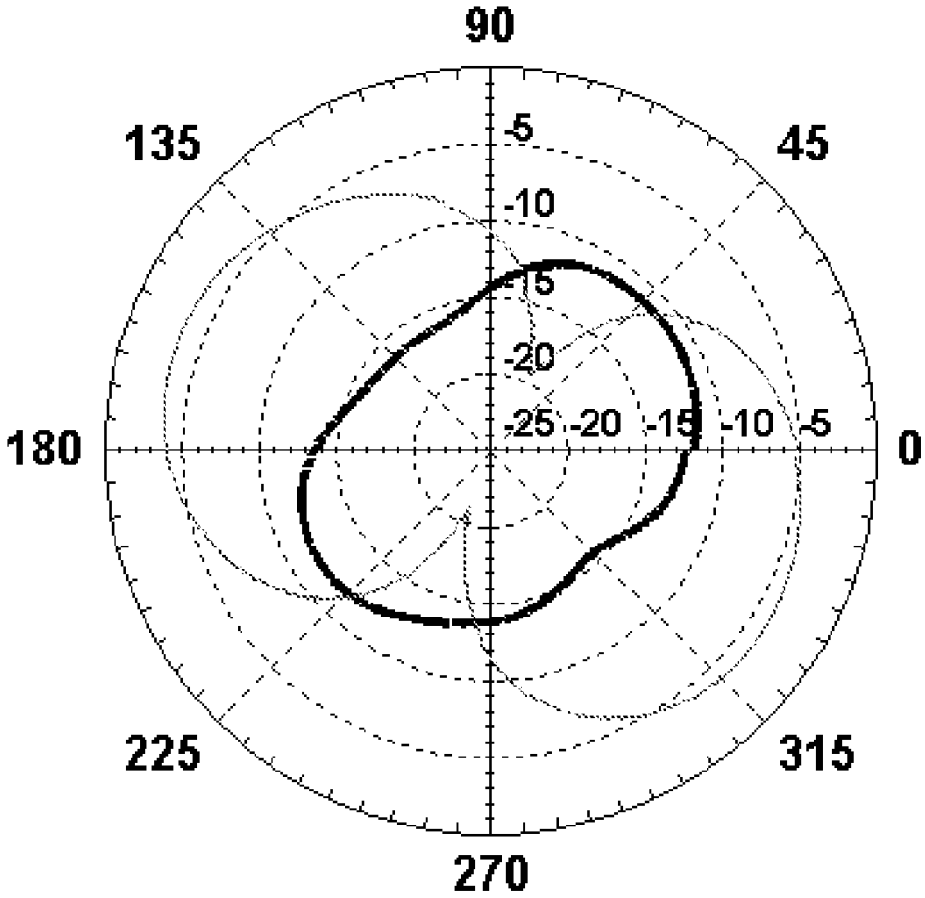

Referring now to FIG. 3, FIG. 4 and FIG. 5, they show the measured horizontal and vertical polarize radiation directional patterns of X-Y, Y-Z and Z-X planes of the triple-band antenna 30 operating at 900 MHz respectively. The triple-band antenna 30 has maximum radiation intensity near 80 degrees and 270 degrees of the X-Y plane when operating at 900 MHz frequency.

Figure 6:
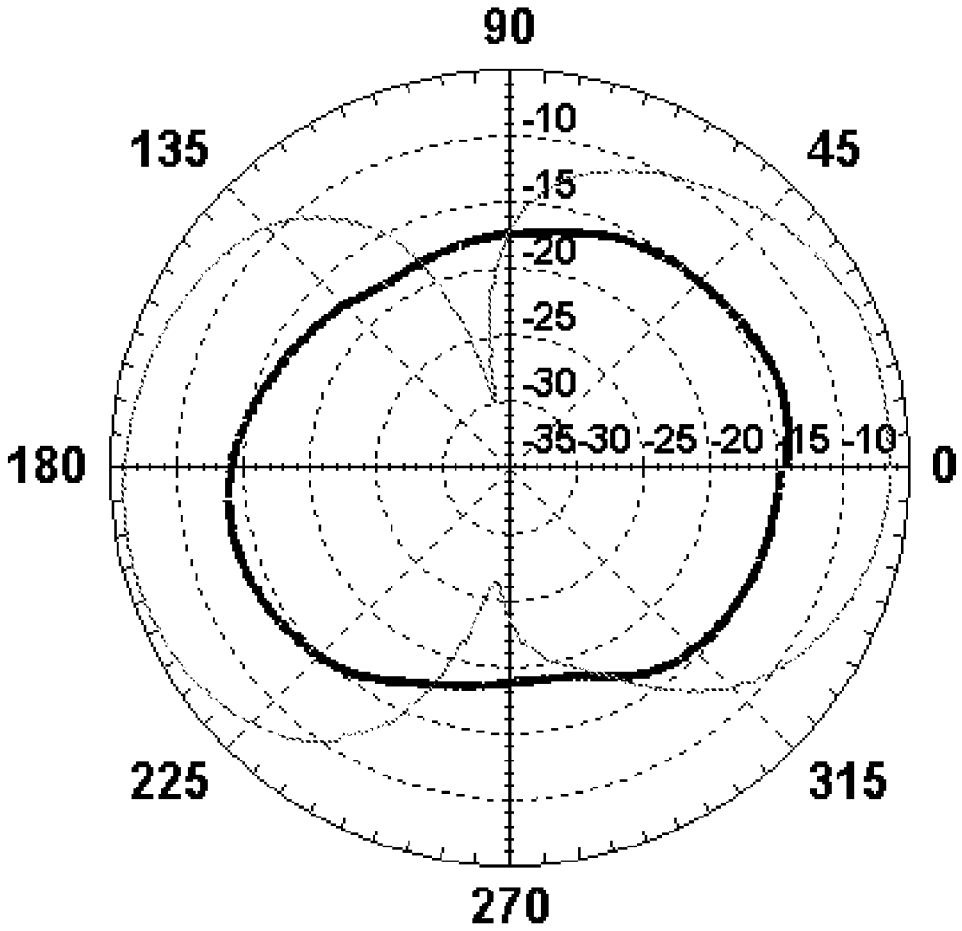
FIGS. 6 to 8 show measured horizontal and vertical polarized radiation directional patterns of X-Y, Y-Z and Z-X planes of the triple-band antenna operating at 1800 MHz respectively.
Figure 7:
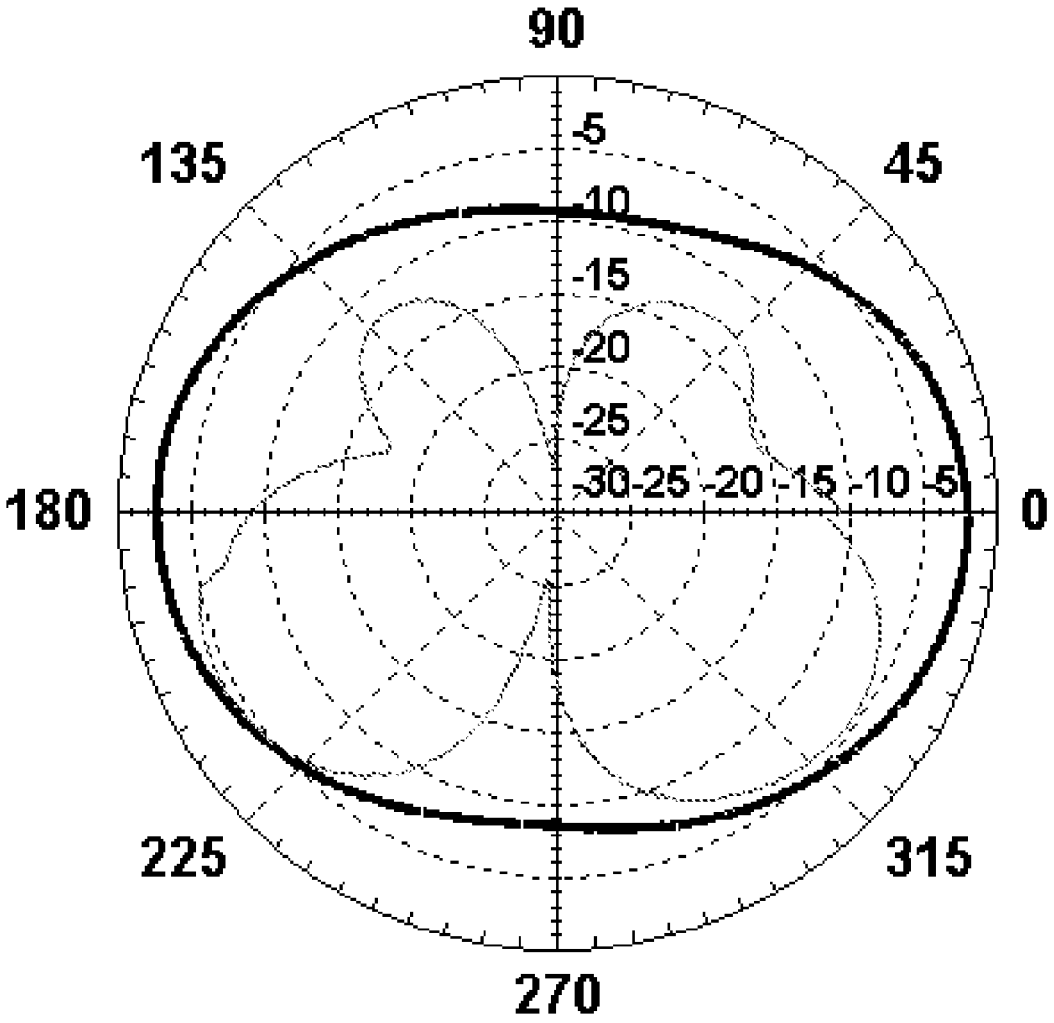
Figure 8:
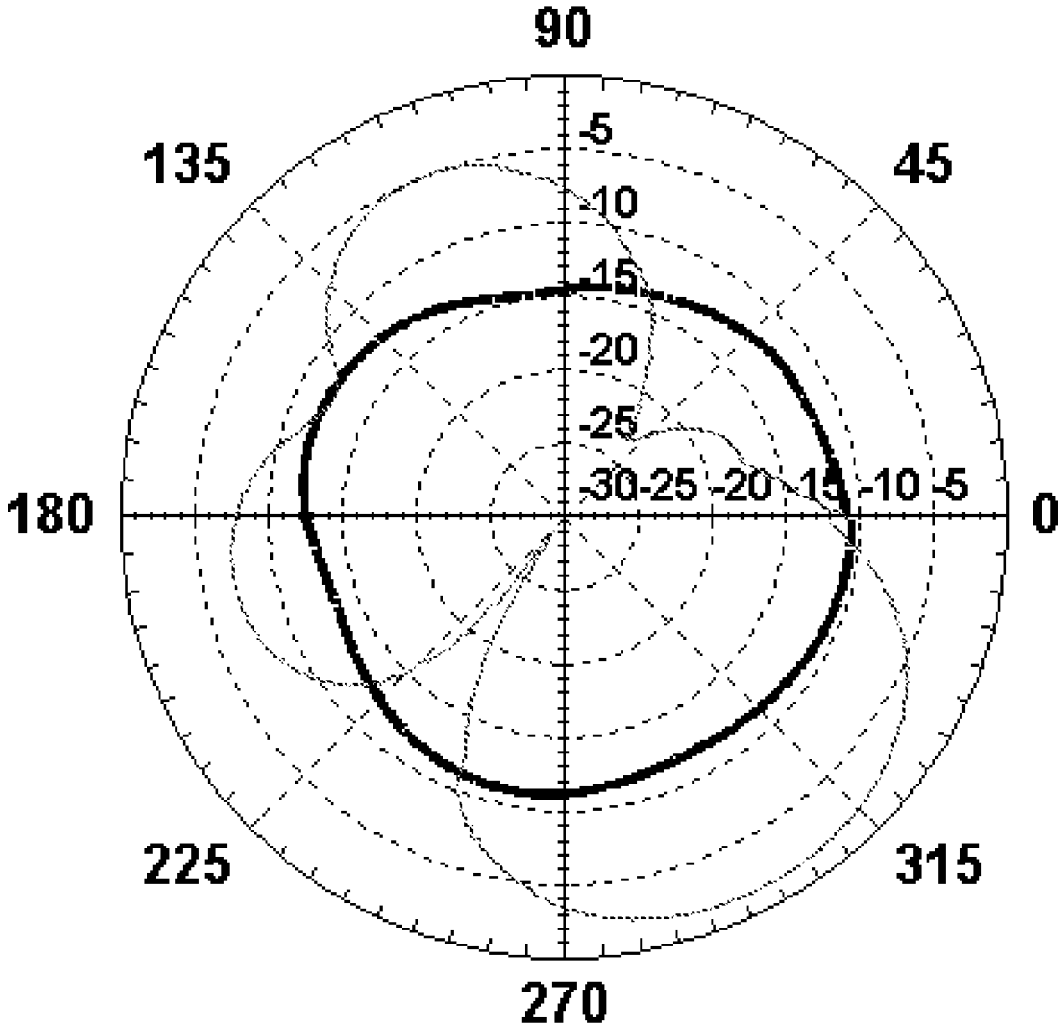

Referring now to FIG. 6, FIG. 7 and FIG. 8, they show the measured horizontal and vertical polarized radiation directional patterns of X-Y, Y-Z and Z-X planes of the triple-band antenna 30 when operating at 1800 MHz respectively. The triple-band antenna 30 has maximum radiation intensity near 0 degrees and 180 degrees of the Y-Z plane when operating at 1800 MHz frequency.

Figure 9:
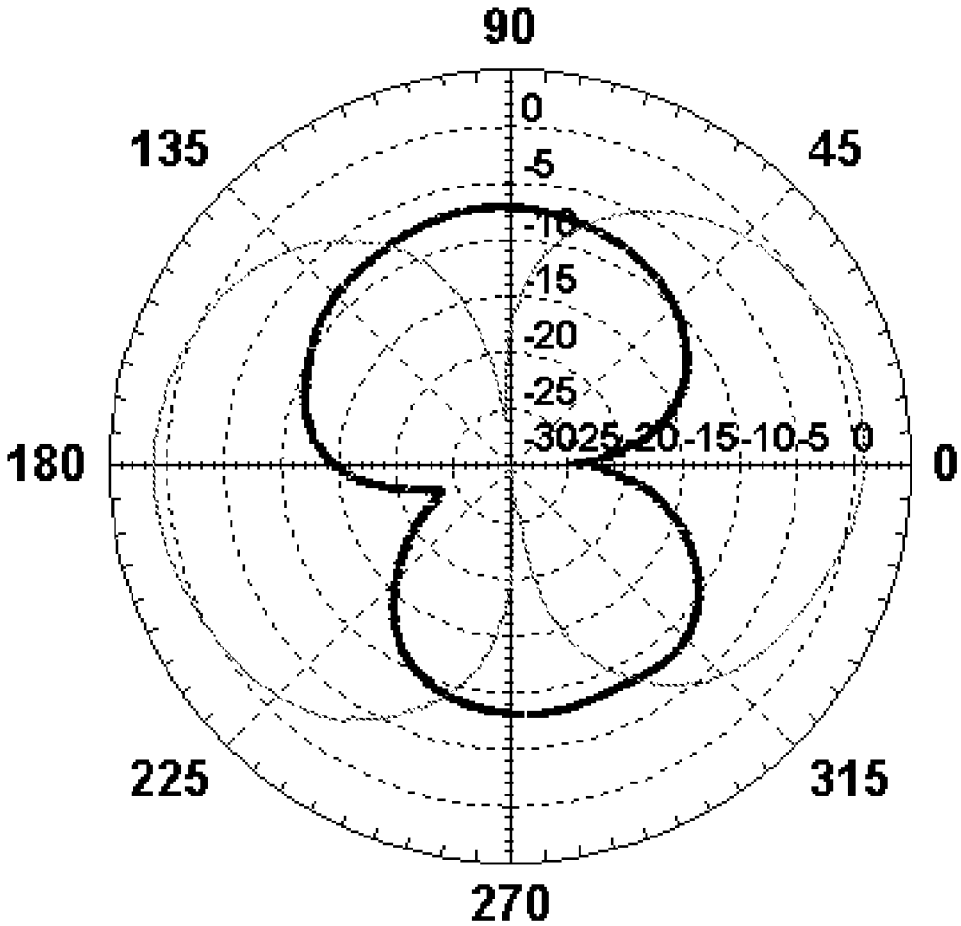
FIGS. 9 to 11 show measured horizontal and vertical polarized radiation directional patterns of X-Y, Y-Z and Z-X planes of the triple-band antenna operating at 245000 MHz respectively.
Figure 10:
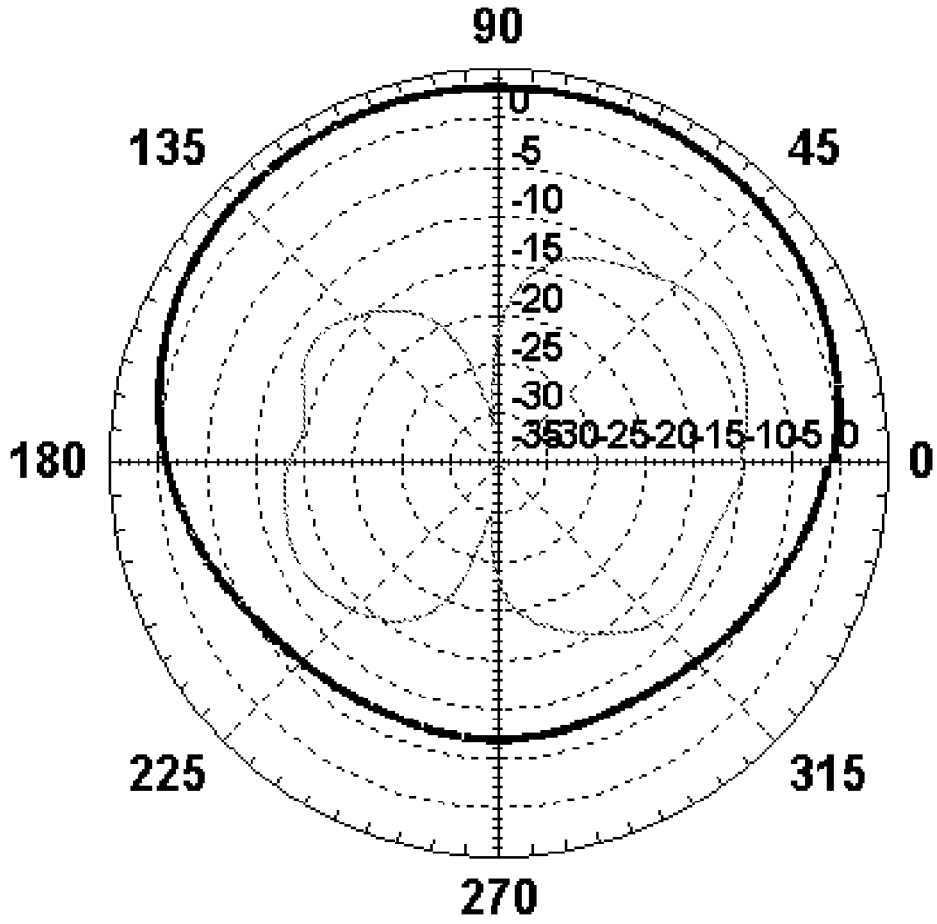
Figure 11:
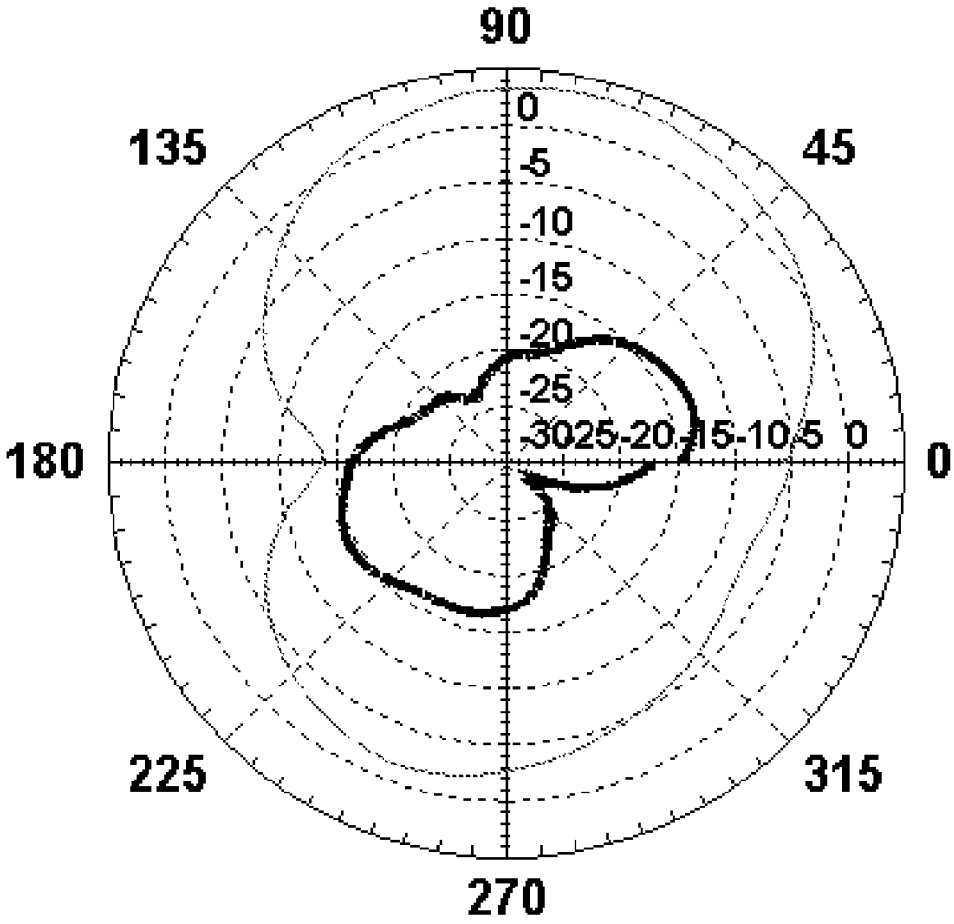

Referring now to FIG. 9, FIG. 10 and FIG. 11, they show the measured horizontal and vertical polarized radiation directional patterns of X-Y, Y-Z and Z-X planes of the triple-band antenna 30 operating at 2450 MHz respectively. The triple-band antenna 30 has maximum radiation intensity near 45 degrees and 135 degrees of the Y-Z plane when operating at 2450 MHz frequency.

Figure 12:
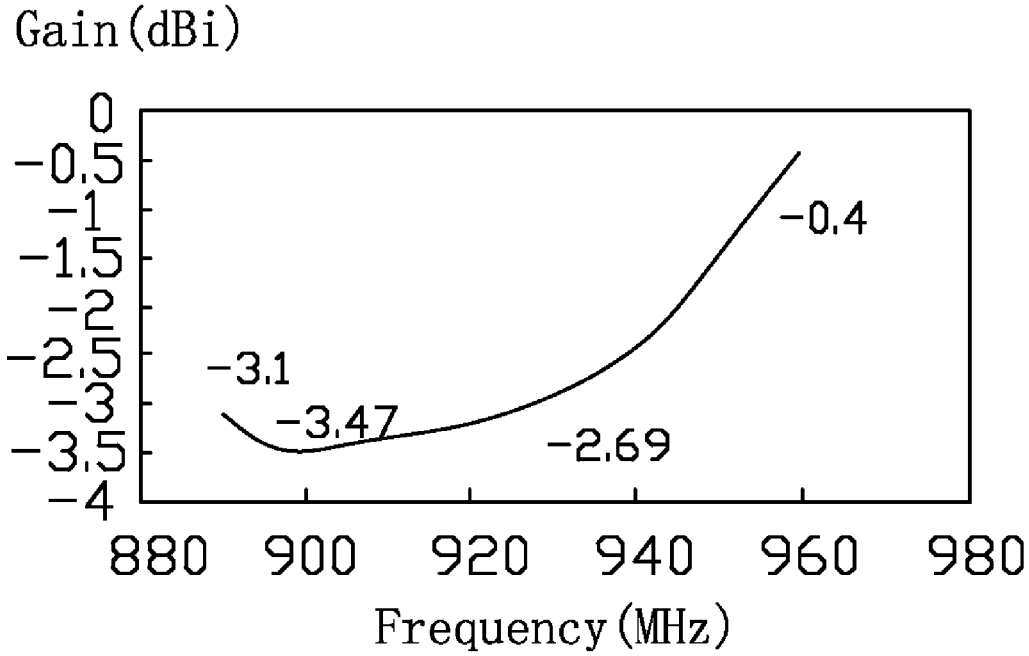
FIGS. 12 to 14 show measured Gain graphs of the triple-band antenna operating at 900 MHz, 1800 MHz and 245000 MHz respectively.
Figure 13:
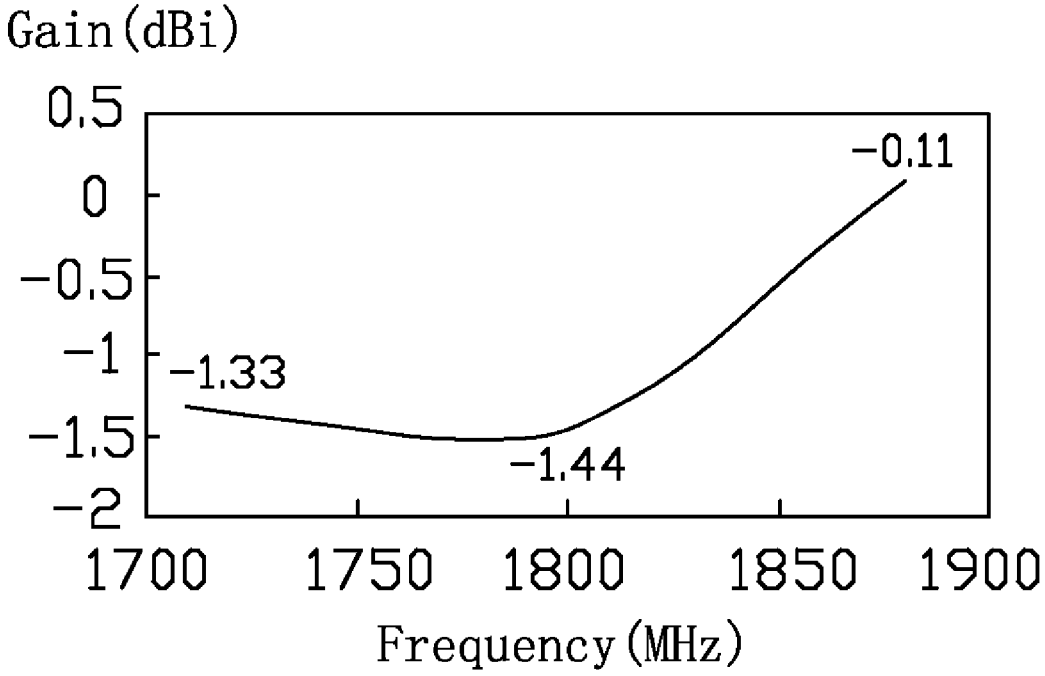
Figure 14:
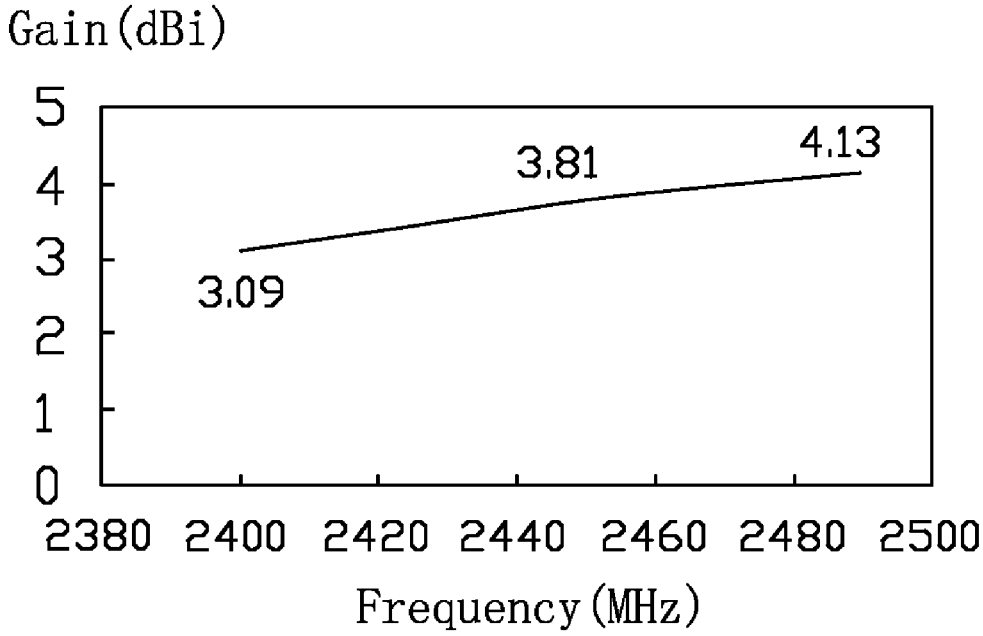

Referring now to FIG. 12, FIG. 13 and FIG. 14, they show the measured Gain graph of the triple-band antenna 30 operating at 900 MHz, 1800 MHz and 245000 MHz respectively. According to the graphs, the gain of the first resonant operating frequency 900 MHz is −3.47~−0.4; the gain of the second resonant operating frequency 1800 MHz is −1.44~0.11; the gain of the third resonant operating frequency 2450 MHz is 3.09~4.13. The aforesaid measured gains of the triple-band antenna 30 satisfy all design parameters.

Finally, it is to be understood, however, that even though numerous characteristics and advantages of the present disclosure have been set fourth in the foregoing description, together with details of the structure and function of the present disclosure, the disclosure is illustrative only, and changes may be made in detail, especially in matters of shape, size, and arrangement of parts within the principles of present disclosure to the full extent indicated by the broad general meaning of the terms in which the appended claims are expressed.

What is claimed is:

1. A triple-band antenna disposed on an insulated board comprising:

a feed line for transmitting and receiving signals;

a frame-shaped first radiating body electrically connecting with an end of the feed line;

a second radiating body comprising three parallel bar sheets extending from the first radiating body and being surrounded by the first radiating body; and a first grounding sheet beside the feed line; wherein when signals are transmitted along the first radiating body, a first resonance operating frequency is generated; when signals are transmitted along the second radiating body, a second resonance operating frequency is generated; and when the signals are transmitted along the first radiating body and the second radiating body, a third resonance operating frequency is generated.

2. The triple-band antenna as claimed in claim 1, wherein the feed line is a longitudinal rectangular sheet, the first radiating body includes a first radiating arm, a second radiating arm, a third radiating arm and a fourth radiating arm electrically connecting with one another in sequence; the first radiating arm perpendicularly disposed beside the feed line and electrically connected with the end of the feed line; the fourth radiating arm parallel with the second radiating arm and the feed line; an end of the fourth radiating arm spaced apart from a junction of the first radiating arm and the feed line.

3. The triple-band antenna as claimed in claim 2, wherein the second radiating body is electrically connected with the second radiating arm of the first radiating body and parallel to the third radiating arm.

4. The triple-band antenna as claimed in claim 3, wherein the triple-band antenna further comprises a second grounding sheet disposed on an other side of the feed line, opposite to the first grounding sheet.

5. The triple-band antenna as claimed in claim 3, wherein adjusting the distance between the first grounding sheet and the feed line adjusts the third resonance frequency of the triple-band antenna.

6. The triple-band antenna as claimed in claim 1, wherein the length of the first radiating body is about ¼ of the wavelength of the first vibration frequency.

7. The triple-band antenna as claimed in claim 6, wherein the triple-band antenna is made of copper material and disposed on the insulated board by engraving.

8. The triple-band antenna as claimed in claim 7, wherein the insulated board is board-shaped and made of fiberglass.

9. The triple-band antenna as claimed in claim 7, wherein the permittivity of the insulated board is about 4.4, the loss tangent is about 0.02 and the thickness is about 1.6 mm.

10. The triple-band antenna as claimed in claim 1, wherein the triple-band antenna is a flat plane antenna feeding in signals using coplanar waveguides.

11. A triple-band antenna disposed on an insulated board comprising:

a feed line for transmitting and receiving signals;

a frame-shaped first radiating body electrically connecting with an end of the feed line;

a second radiating body comprising three parallel bar sheets extending from the first radiating body and being surrounded by the first radiating body; and two grounding sheets including a first grounding sheet and a second grounding sheet oppositely and adjustably disposed at the two opposite sides of the feed line, wherein when signals are transmitted along the first radiating body, a first resonance operating frequency is generated; when signals are transmitted along the second radiating body, a second resonance operating frequency is generated; and when the signals are transmitted along the first radiating body and the second radiating body, a third resonance operating frequency is generated.

12. The triple-band antenna as claimed in claim 11, wherein the feed line is a longitudinal rectangular sheet, the first radiating body includes a first radiating arm, a second radiating arm, a third radiating arm and a fourth radiating arm electrically connecting with one another in sequence; the first radiating arm perpendicularly disposed beside the feed line and electrically connected with the end of the feed line; the fourth radiating arm parallel with the second radiating arm and the feed line; an end of the fourth radiating arm spaced apart from a junction of the first radiating arm and the feed line.

13. The triple-band antenna as claimed in claim 12, wherein the second radiating body is electrically connected with the second radiating arm of the first radiating body and parallel to the third radiating arm.

14. The triple-band antenna as claimed in claim 13, wherein adjusting the distance between the first grounding sheet and the feed line adjusts the third resonance frequency of the triple-band antenna.

15. The triple-band antenna as claimed in claim 11, wherein the length of the first radiating body is about ¼ of the wavelength of the first vibration frequency.

16. The triple-band antenna as claimed in claim 14, wherein the triple-band antenna is made of copper material and disposed on the insulated board by engraving.

17. The triple-band antenna as claimed in claim 16, wherein the insulated board is board-shaped and made of fiberglass.

18. The triple-band antenna as claimed in claim 17, wherein the permittivity of the insulated board is about 4.4, the loss tangent is about 0.02 and the thickness is about 1.6 mm.

19. The triple-band antenna as claimed in claim 11, wherein the triple-band antenna is a flat plane antenna feeding in signals using coplanar waveguides.

* * * * *